US005899686A

United States Patent [19]

Carbone et al.

[11] Patent Number: 5,899,686

[45] Date of Patent: May 4, 1999

[54] GAS BURNER APPARATUS HAVING A FLAME HOLDER STRUCTURE WITH A CONTOURED SURFACE

[75] Inventors: Philip Carbone, North Reading; Karen Benedek, Winchester; Michael J. Farina, Waltham, all of Mass.

[73] Assignee: Gas Research Institute, Chicago, Ill.

[21] Appl. No.: 08/912,767

[22] Filed: Aug. 18, 1997

Related U.S. Application Data

[ 60] Provisional application No. 60/024,170, Aug. 19, 1996.

[51] Int. Cl.[6] ..... F23D 14/12

[52] U.S. Cl. ..... 431/328; 431/12; 126/92 AC; 126/91 A

[58] Field of Search ..... 431/328, 326, 431/12, 7; 126/92 R, 92 AC, 39 R, 41 R, 85 R, 91 A, 92 B, 92 C; 239/145

[56] References Cited

U.S. PATENT DOCUMENTS

| | | | |
|---|---|---|---|
| 3,170,504 | 2/1965 | Lanning | 431/328 |
| 4,118,172 | 10/1978 | Noir et al. | 431/42 |
| 4,296,727 | 10/1981 | Bryan | 126/116 A |
| 4,340,357 | 7/1982 | Kito et al. | 431/328 |
| 4,568,266 | 2/1986 | Bonne | 431/76 |
| 4,688,547 | 8/1987 | Ballard et al. | 126/116 A |
| 4,695,246 | 9/1987 | Beilfuss et al. | 431/31 |
| 4,729,207 | 3/1988 | Dempsey et al. | 126/112 |
| 4,927,350 | 5/1990 | Zabielski | 431/12 |
| 4,982,721 | 1/1991 | Lynch | 126/116 A |
| 5,037,291 | 8/1991 | Clark | 431/12 |
| 5,112,217 | 5/1992 | Ripka et al. | 431/12 |
| 5,169,301 | 12/1992 | Donnelly et al. | 431/20 |
| 5,224,542 | 7/1993 | Hemsath | 431/328 |
| 5,481,965 | 1/1996 | Kronman | 126/41 R |

FOREIGN PATENT DOCUMENTS

| | | | |
|---|---|---|---|
| 57-187517 | 11/1992 | Japan | 431/328 |

*Primary Examiner*—Ira S. Lazarus
*Assistant Examiner*—Josiah Cocks
*Attorney, Agent, or Firm*—Pauley Petersen Kinne & Fejer

[57] ABSTRACT

A burner apparatus for gas-fired appliances, such as gas furnaces. The burner apparatus includes an improved flame holder structure, with a contoured surface, for controlling the shape and contour of the flame.

15 Claims, 10 Drawing Sheets

| | # OF HOLES | RADIUS | POSITION |
|---|---|---|---|
| 1 | 1 | 0.000 | 0 |
| 2 | 6 | 0.085 | 0 |
| 3 | 12 | 0.142 | 0 |
| 4 | 12 | 0.198 | 0 |
| 5 | 12 | 0.255 | 0 |
| 6 | 12 | 0.287 | 9.83 |
| 7 | 12 | 0.287 | 350.17 |
| 8 | 12 | 0.312 | 0 |
| 9 | 12 | 0.343 | 8.21 |
| 10 | 12 | 0.343 | 351.79 |
| 11 | 12 | 0.368 | 0 |
| 12 | 12 | 0.425 | 0 |
| 13 | 12 | 0.456 | 6.18 |
| 14 | 12 | 0.456 | 353.82 |
| 15 | 12 | 0.482 | 0 |
| 16 | 12 | 0.512 | 5.50 |
| 17 | 12 | 0.512 | 354.50 |
| 18 | 12 | 0.538 | 0 |
| 19 | 24 | 0.595 | 0 |
| 20 | 24 | 0.625 | 4.50 |
| 21 | 24 | 0.625 | 355.50 |
| 22 | 24 | 0.651 | 0 |
| 23 | 24 | 0.682 | 4.13 |
| 24 | 24 | 0.682 | 355.87 |
| 25 | 24 | 0.708 | 0 |
| 26 | 48 | 0.772 | 0 |

TOTAL = 415

| | # OF HOLES | RADIUS | POSITION |
|---|---|---|---|
| 1 | 1 | 0.000 | 0 |
| 2 | 6 | 0.188 | 0 |
| 3 | 12 | 0.313 | 15 |
| 4 | 12 | 0.438 | 0 |
| 5 | 24 | 0.615 | 0 |
| 6 | 24 | 0.729 | 7.5 |

TOTAL = 79

GAS BURNER APPARATUS HAVING A FLAME HOLDER STRUCTURE WITH A CONTOURED SURFACE

This application depends from and claims priority under 35 U.S.C. §119(e) of U.S. Provisional Application No. 60/024,170, filed Aug. 19, 1996, the disclosure of which is incorporated herein by reference.

BACKGROUND OF THE INVENTION

1. The Technical Field

The present invention relates to gas burner apparatus, and in particular, to gas burner plates, such as may be used in gas-burning furnaces.

2. The Prior Art

Gas burners exist in a variety of configurations, depending upon the type of burner function contemplated. For example, there are gas burners which are designed for radiant heating operation, in which the gas flame is contemplated to more or less reside on the surface of the burner plate or flame holder. Other burner configurations are designed to provide for controlled flow of the gas and/or combustion air which is being projected through the burner plate, and the flame is contemplated as being positioned in a stable manner, extending for some distance from the burner plate or flame holder.

Regardless of the particular type or intended function of the burner apparatus, all have certain common goals in their design. These include: 1) quiet operation; 2) support of a stable flame; 3) efficient transfer of the heat generated to the desired destination, whether it is a particular surface, as in a heat exchanger, or directly to a mass of air or other fluid; 4) and complete combustion.

One example of a prior art burner apparatus is disclosed in Naito, U.S. Pat. No. 4,063,873. The Naito '873 reference discloses an infrared gas burner plate, having a plurality of diamond-shaped depressions and projections. A number of apertures for combustion air and gas are distributed throughout the inclined surfaces of the depressions and projections. All of the apertures are the ends of parallel passageways through the burner plate, and each aperture has a diameter which is substantially less than the length of its associated passageway.

It would be desirable to provide a burner plate apparatus which is configured to provide a stable flame, for blue flame combustion operation, over a wide range of firing rates and fuel/air ratios.

An additional desirable feature would be to provide a burner apparatus which is quieter, and one which has improved flame geometry, with reduced flame spread and reduced tendency of the flame to impinge upon the side walls of heat exchanger structures, thereby lowering heat exchanger temperature and reducing CO generation.

It would additionally be desirable to provide a such burner apparatus as a fully premixed burner apparatus.

Still another object of the invention would be to provide such a burner apparatus to be suitable for use in gas furnace environments.

These and other objects of the invention will become apparent in light of the present specification, claims and drawings.

SUMMARY OF THE INVENTION

The present invention is directed to a flame holder apparatus, for use with burner apparatus for gaseous fuels, of the type configured for holding a flame and directing the combustion products of the flame into a heat exchanger plenum.

The flame holder apparatus comprises a plate member, having at least one flame holder region having a plurality of apertures. The apertures are configured into two regions. The apertures of a first region are disposed for directing flow through the plate and in a radially outward direction, relative to the at least one flame holder region. The apertures of a second region are disposed for directing flow through the plate and in a radially inward direction, relative to the at least one flame holder region.

Preferably, the at least one flame holder region further has a generally circular plan configuration. The first region comprises a circular area, centrally positioned in the at least one flame holder region. The second region comprises an annular area, surrounding the first region.

Alternatively, the first region comprises a convex conical region, centrally positioned in the at least one flame holder region. The second region comprises an annular concave conical region centered within the at least one flame holder region.

Preferably, the apertures in the plate are configured so that the flow of gas through the plate at each location on the plate is substantially perpendicular to the plate at that respective location.

Preferably, the apertures have predominantly uniform diameters.

In an alternative embodiment of the invention, a plurality of apertures is positioned around a peripheral region of the at least one flame holder region, which have diameters which are greater than the diameters of the apertures in remaining portions of the at least one flame holder region.

Preferably, the apertures have diameters which are of the same order of magnitude as the lengths of the apertures through the plate.

In an alternative embodiment of the invention, the at least one flame holder region comprises two flame holder regions disposed on the plate member, at laterally spaced positions relative to one another. A plurality of apertures is disposed substantially linearly between the two flame holder regions for providing cross-lighting between the two flame holder regions.

Preferably, at least some of the apertures in the at least one flame holder region are arranged in hexagonal groups. Preferably, at least some of the apertures in the first region are arranged in hexagonal groups.

BEST MODE FOR CARRYING OUT THE INVENTION

Figure 1:
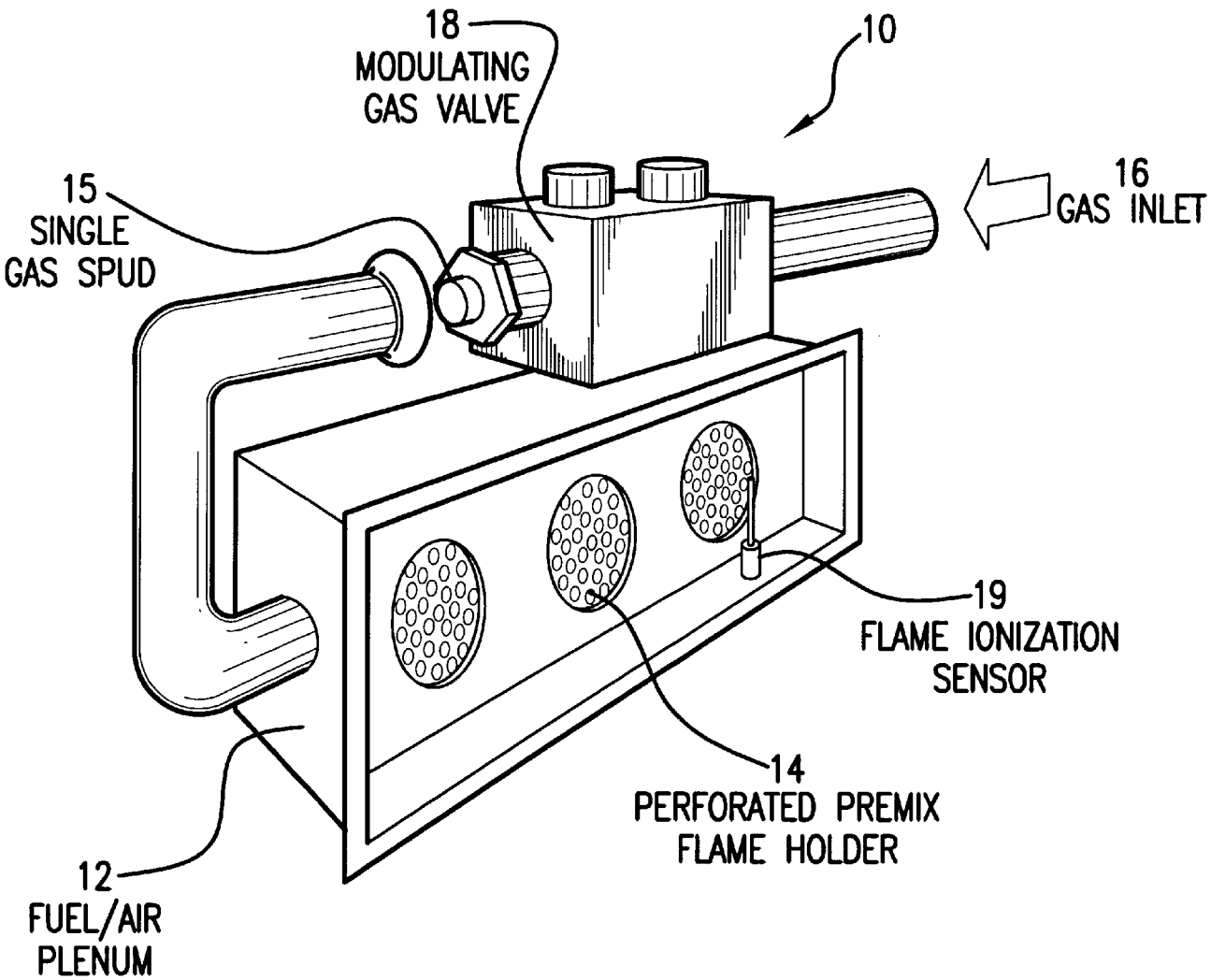
FIG. 1 is a perspective view of a burner apparatus according to one embodiment of the invention.

While this invention is susceptible of embodiment in many different forms, there is shown in the drawings and will be described herein in detail, several embodiments, with the understanding that the present disclosure is to be considered as an exemplification of the principles of the invention and is not intended to limit the invention to the embodiments illustrated.

The present invention is directed to burner apparatus, in particular fully premixed, gas-fired, induced draft burners, configured to fire into tubular or clamshell-type heat exchangers, such as are found in residential warm air furnaces.

FIG. 1 illustrates, according to one embodiment of the present invention, a gas burner/plenum 10, in accordance with the principles of the present invention, as might be used in a gas furnace for a domestic residence or other occupied space. Gas burner/plenum 10 is of the premixed gas/air variety, in which the fuel gas and all of the intended combustion air is premixed in an inlet plenum 12, prior to ignition of the gas and air. Burner/plenum 10 includes a plurality of perforated flame holders 14 which are each fed by gas spud 15.

In an embodiment of the invention, gas is delivered to burner/plenum 10 by inlet 16, and regulated through a gas valve 18, which may be a conventional gas valve, a stepped valve or even a modulating gas valve. In order to enable control of the combustion process, a flame sensor 19 (FIGS. 1 and 2) is provided which senses the stoichiometry of the flame, as a function of the degree of ionization in the flame. While conventional control methods for regulating the operation of the valve may be used, one suitable control method for regulating the operation of a gas burner may be found in copending U.S. Ser. No. 08/747,777, filed Nov. 13, 1996, the complete disclosure of which is incorporated herein by reference.

Figure 2:
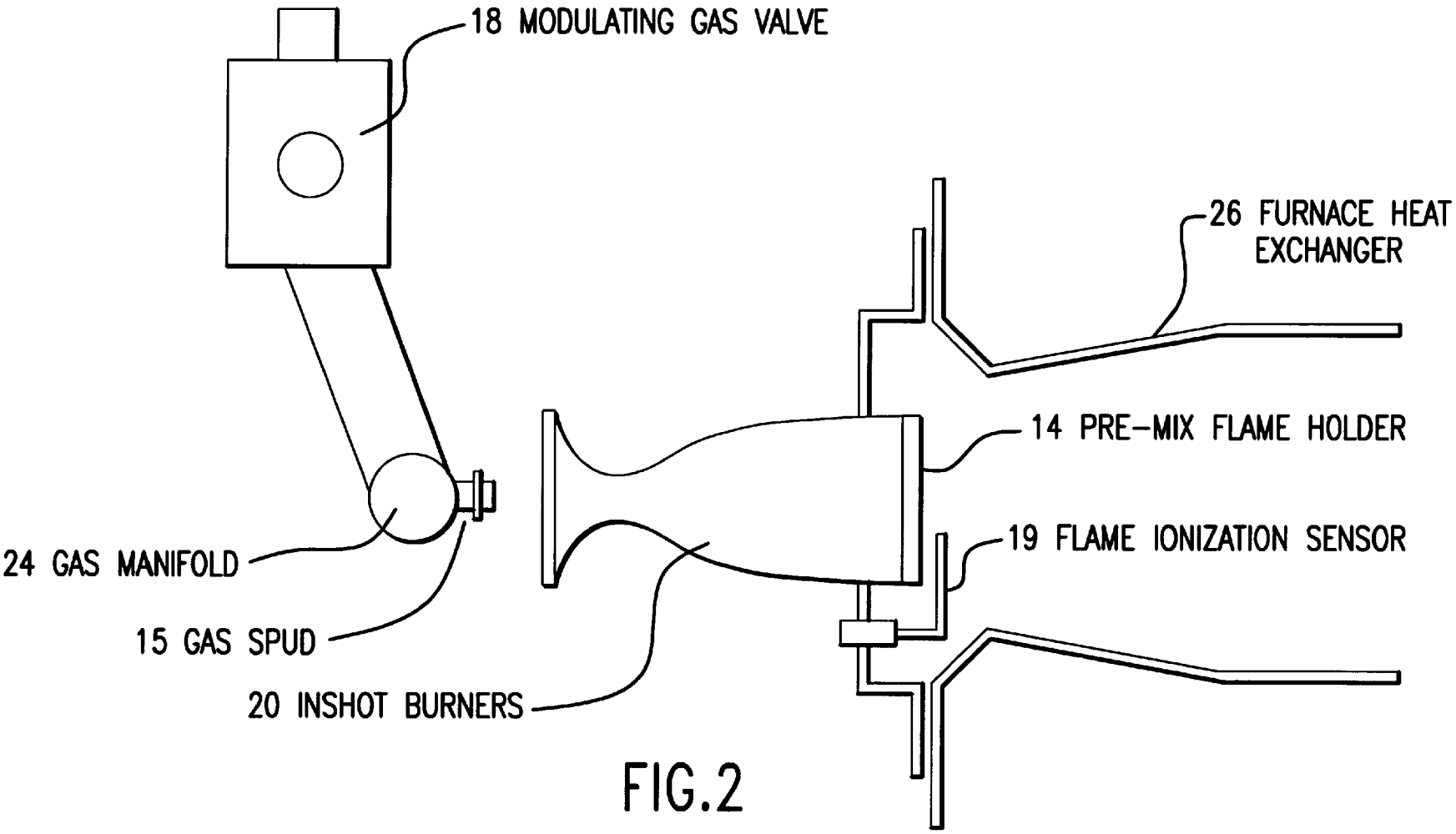
FIG. 2 is a schematic view of a burner apparatus system, suitable for use in the environment of the present invention.

FIG. 2 illustrates schematically an alternative burner configuration, in which one or more inshot burners 20, each having a flame holder 14, which will be supplied gas and combustion air by corresponding one or more respective gas spuds 15, each of which is associated with a manifold 24. Each of the burners 20 opens to a heat exchanger 26, for delivery of the heat generated by the combustion process.

Figure 3:
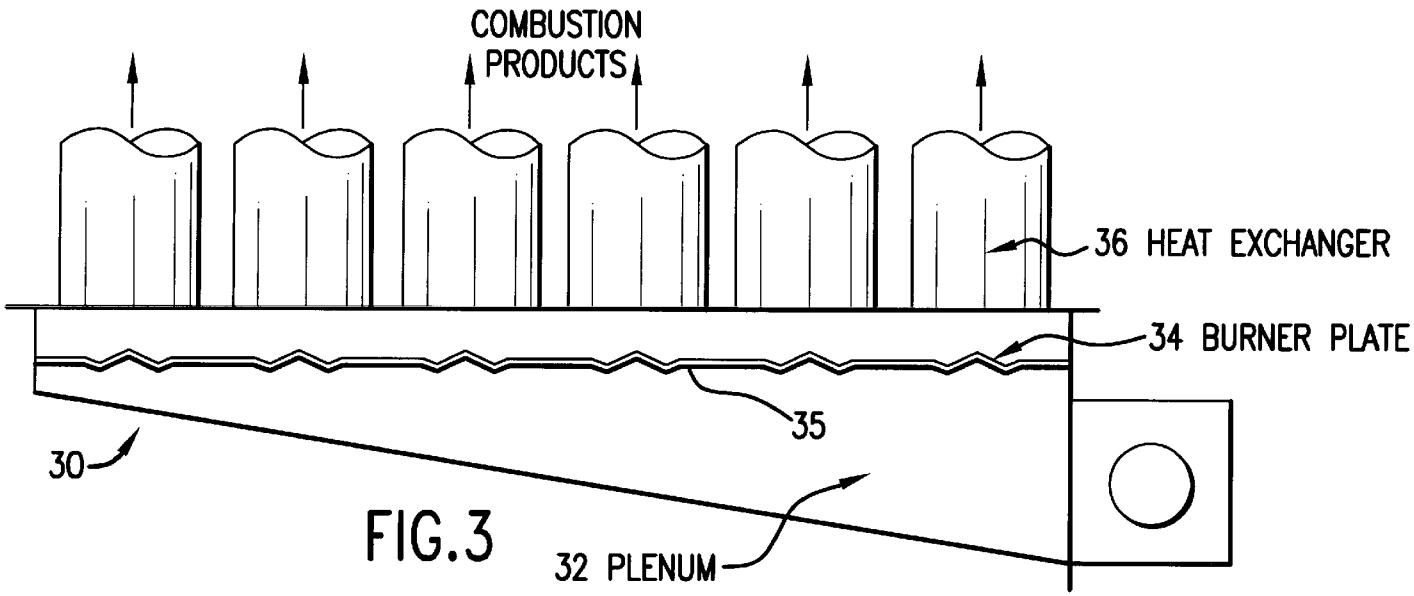
FIG. 3 is a top plan view of one embodiment of a burner apparatus incorporating a burner plate of the present invention, showing a contemplated inlet plenum configuration.
Figure 4:
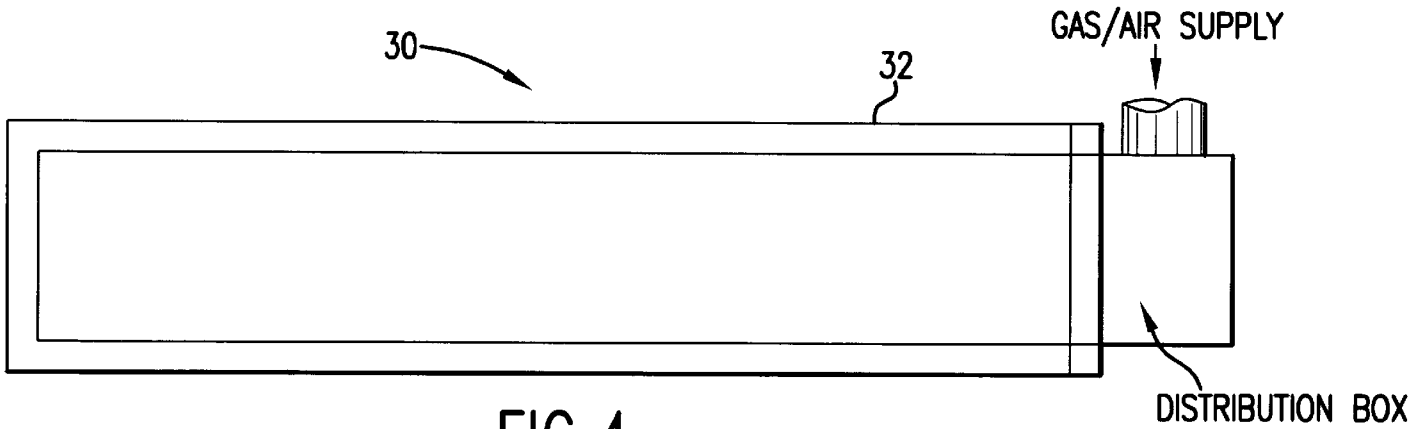
FIG. 4 is a front view of the burner apparatus and inlet plenum configuration, according to the embodiment of FIG. 3.

FIGS. 3 and 4 illustrate a burner/plenum configuration 30, having a side feed plenum 32. Plenum 32 may have a trapezoidal cross-sectional plan configuration, as indicated in FIG. 3. Burner plate (flame holder) 34 is positioned in the side of plenum 32 which opens onto the furnace heat exchanger 36. Baffle plate 35 is positioned immediately upstream of burner plate 34. After passing through the furnace heat exchanger 36, the combustion products are directed to a suitable flue or chimney out of the occupied space.

Figure 5A:
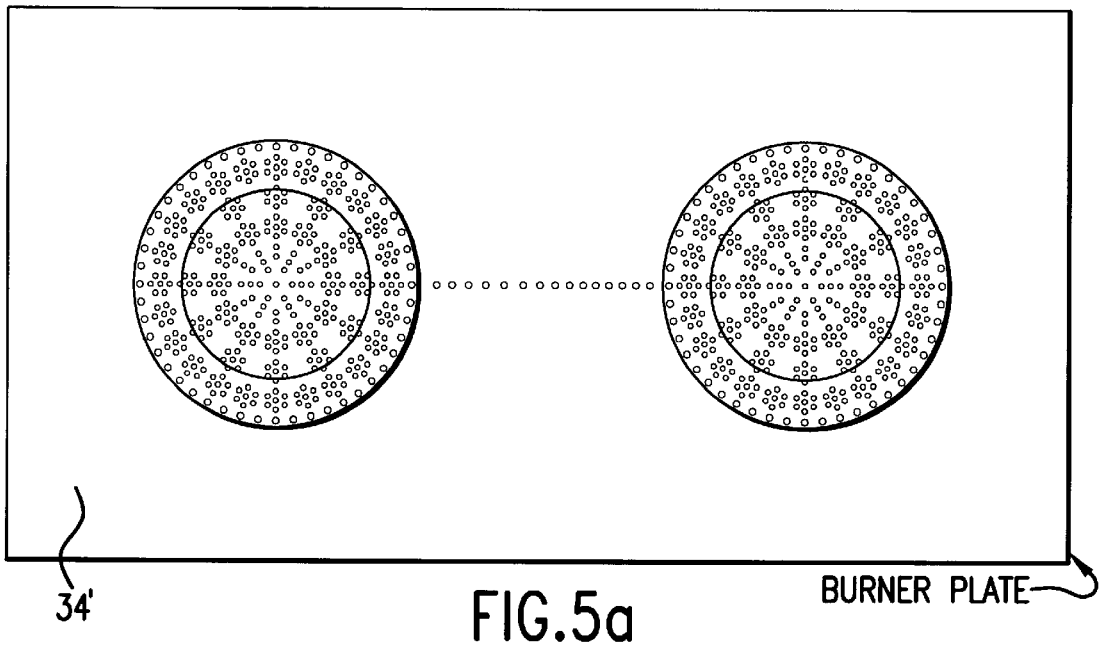
FIG. 5*a* is a plan view of a burner plate, according to another embodiment of the present invention.
Figure 5B:
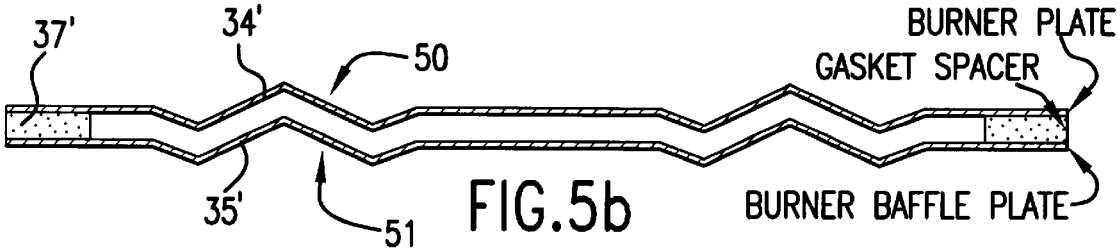
FIG. 5*b* is a side elevation of the burner plate and a corresponding baffle plate, according to the embodiment of FIG. 5*a*.
Figure 5C:
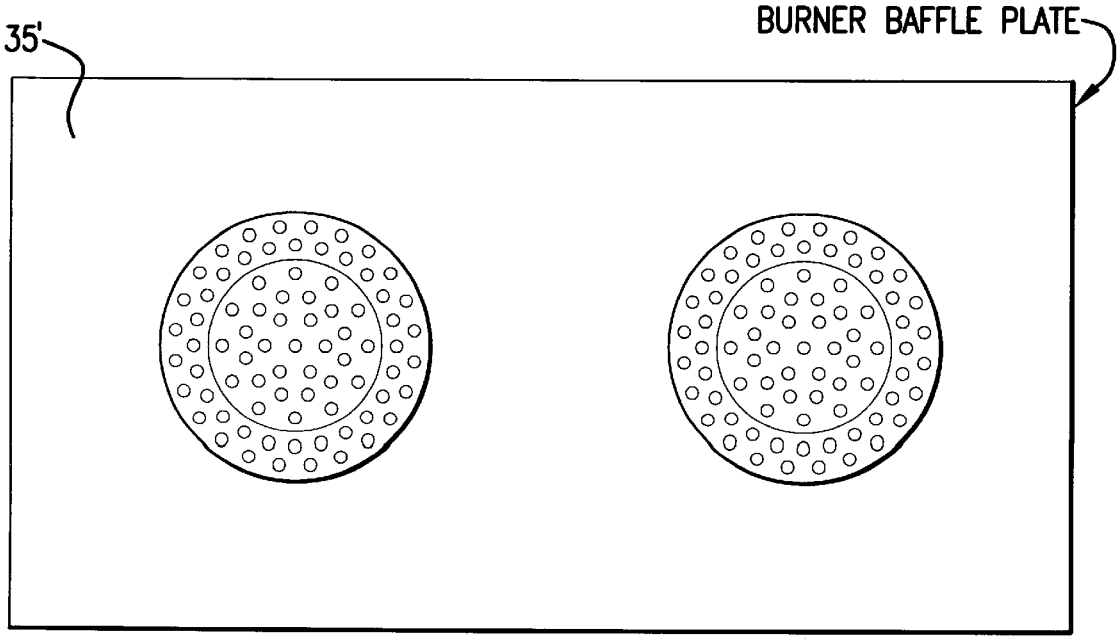
FIG. 5*c* is a plan view of the baffle plate corresponding to the burner plate of FIG. 5*a*.

FIGS. 5*a*–5*c* illustrate a burner plate 34' and a baffle plate 35', in accordance with the principles of the present invention, having preferred porting configurations. Plates 34' and 35' are configured for two flame holder regions each. If a greater or lesser number of flame holder regions are desired (as shown in the other embodiments described herein), then plates 34' and 35' may simply be suitably shortened or lengthened, in accordance with conventional design principles by one of ordinary skill in the art having the present disclosure before them.

However many flame holder regions are provided, each burner plate (e.g., 34') and its corresponding baffle plate (e.g., 35') will have substantially identical profiles, as shown in FIG. 5*b*. Gasket/spacer members 37' will be positioned between burner plate 34' and baffle plate 35'.

The baffle plate is believed to provide assistance for distributing the mixed fuel gas and air across the width of the burner plate, and to assist in pressure recovery of the mixed fuel gas and air. The presence of the baffle plate is further believed to help reduce CO production, and to facilitate burner ignition.

Figure 6:
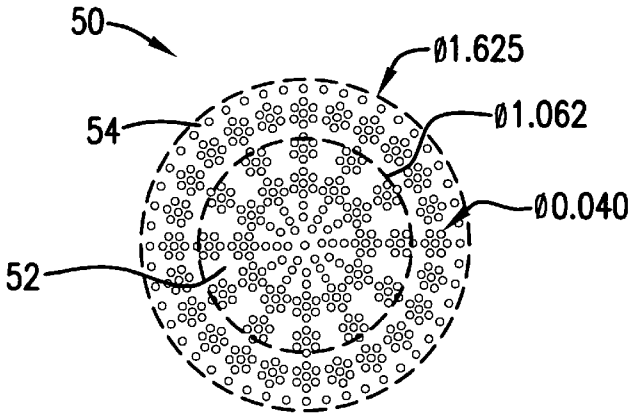
FIG. 6 is a plan view of a flame holder configuration, according to a preferred embodiment of the invention.
Figure 7:
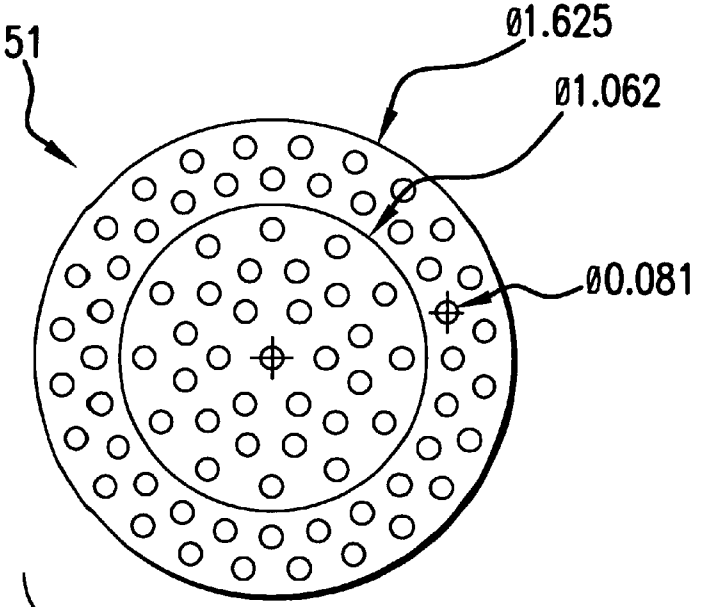
FIG. 7 is a plan view of a burner plate configured to accompany the flame holder configuration of FIG. 6.

FIGS. 6 and 7 illustrate the preferred port locations and patterns for the flame holder region of a burner plate and its corresponding baffle plate region, in accordance with the principles of the present invention, for a desired port loading and burner rating. Although specific aperture sizes and locations are given, such values may be modified as necessary for a given application, by one of ordinary skill in the art having the present disclosure before them.

Figure 8:
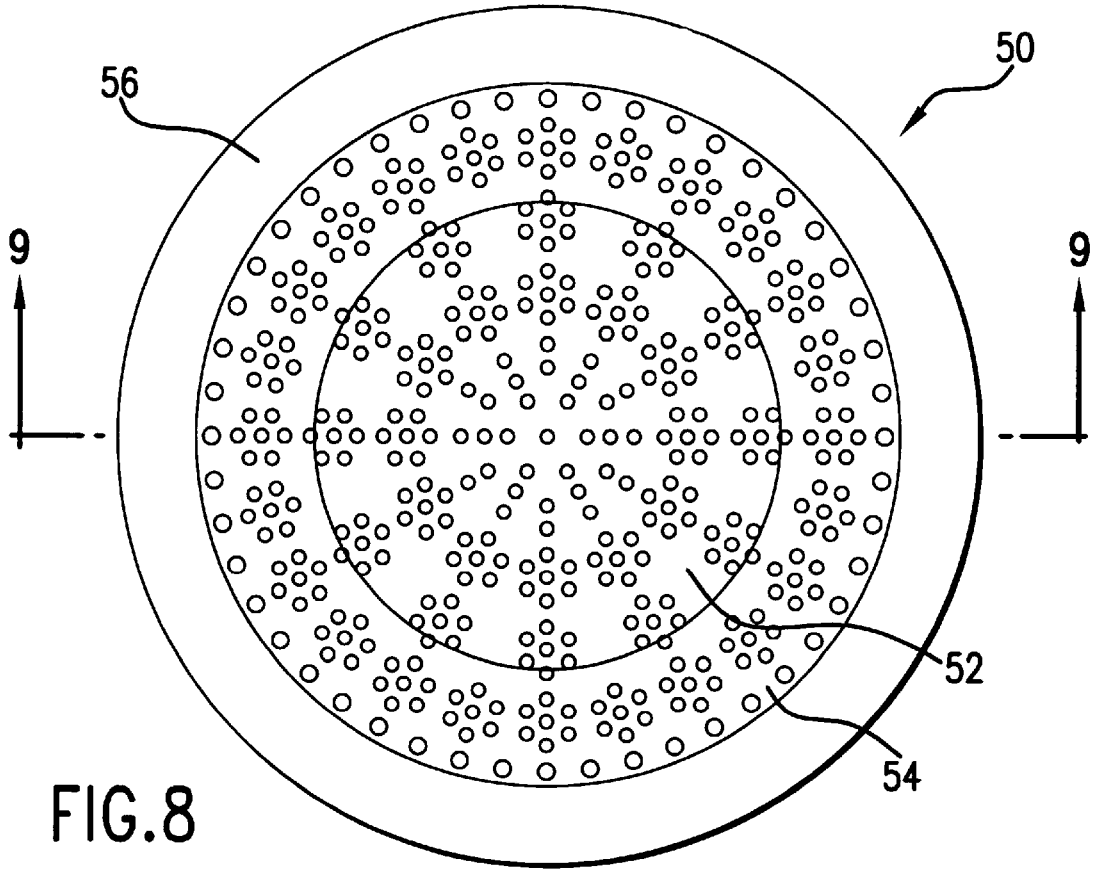
FIG. 8 is a further top plan view of the flame holder configuration of FIG. 6.
Figure 9:
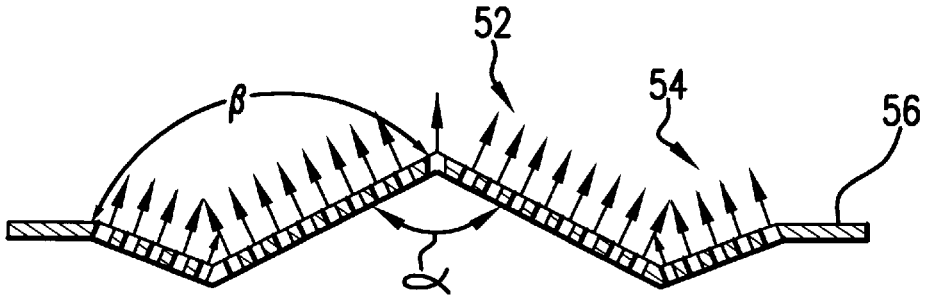
FIG. 9 is a side elevation of the flame holder configuration of FIG. 8, illustrating the mixed gas flow paths.

FIGS. 8 and 9 illustrate a preferred flame holder region configuration for a burner plate in accordance with the principles of the present invention. Flame holder region 50 may be a flame holder for a single flame burner plate, or as previously indicated, two or more flame holder regions 50 may be formed on a single elongated burner plate. If a plurality of flame holder regions are provided, one or more rows of apertures will be provided to connect the separate flame holder regions, to enable cross-lighting from one flame holder region to the other. Each flame holder region 50 preferably is circular and in the form of a convex (outwardly pointing) cone, placed within a conical depression. As seen in FIGS. 8 and 9, each flame holder region 50 comprises upwardly/outwardly projecting conical portion 52, set within conical depression portion 54, which, in turn, is surrounded by a flat region 56. Each flame holder region 50 is provided with a plurality of apertures, which may be provided in the preferred pattern illustrated, and having the dimensions and locations provided in FIG. 6.

Preferably, the side profile of the flame holder region of FIGS. 8 and 9, has a center convex cone having an included angle alpha in the range of approximately 110° to 150°, preferably 130°, and an outer concave conical ring, defining an angle beta, as shown in FIG. 9, in the range of the focus of which has an included angle beta in the range of 155° to 115°, preferably 135°. The apertures are preferably of the same diameter, although the outermost single ring of apertures may be of a slightly larger diameter. The apertures should have a diameter between 0.060" as a maximum, and the burner plate thickness, as a minimum.

The angles of the profile of the port region 51 of baffle plate(s) 35, 35' will be the same as the corresponding angles of flame holder region 50 of burner plates 34, 34'.

Whether having only a single flame holder region or a plurality of flame holder regions, the burner plate is formed from a thin plate (preferably in the range of 0.024"–0.032" thick), relative to its length or width. A preferable method for manufacture of such a burner plate would be to take a flat plate, and form the holes by drilling or punching. Afterward, the conical forms are created by further stamping. As such, the holes have diameters which are the same general order of magnitude as the thickness of the plate and, in turn, the lengths of the passages through the plate. The loading on each port can be in the range of 5000–70000 Btu/hr in$^2$, with a preferred maximum loading, for the configuration illustrated in FIG. 8, of 50000 Btu/hr in$^2$. The burner plate is designed to achieve the desired port loading, with a minimum material thickness between the apertures equal to approximately the radius of the apertures.

The flow pattern of the gases as they exit the flame holder region is as illustrated in FIG. 9. Once the plate has been stamped or otherwise formed, after the apertures have been drilled, to have the conical profile shown in FIG. 9, the fluid flow through the plate, at any given location in the flame holder region, is generally perpendicular to the immediately surrounding plate surface at that given location. This is believed to possibly be the result, at least in part, of the fact that the side walls of the individual apertures are, after stamping or other forming, likewise generally perpendicular to the immediately surrounding plate surface at that given location. The flow of the gases, from the central portion (the elevated cone) 52 is upwardly and radially outward, with the exception of the aperture at the precise apex of the cone. In the conical depression region 54 surrounding the upraised cone 52, the flow is upward and radially inward. This has the effect of directing the individual flamelet groups around the periphery of the flame holder region toward the center of the flame, and away from the side walls of the heat exchanger. This helps prevent impingement of the outer flamelet groups against the side walls, and the resultant quenching, caused by sudden heat loss, of those flamelet groups which might otherwise occur upon such contact. In turn, this flame holder construction helps keep the periphery of the flame hot, which helps aerodynamically stabilize the overall flame and help prevent flame lift-off from the burner plate.

An additional feature which is believed to assist in the improvement of the flame characteristics is the clustering of groups of apertures. The hexagonal patterns (with apertures in the centers of the hexagons) is believed to impart stability to the individual flamelets and thus maintain a quiet flame. The connecting apertures in between the hexagons help keep the flame shape continuous, and assure complete involvement of all the apertures. A further advantage of the burner configurations of the present invention is that a greater capacity for turndown of heat input (approx. 6:1 or greater) is obtainable, as opposed to conventional burner systems, having partially premixed gas and air (approx. 3:1 max.).

The present invention is also directed to an improved burner housing and plenum configuration, for enhancing the operation of the burner plate apparatus described hereinabove.

Figure 11:
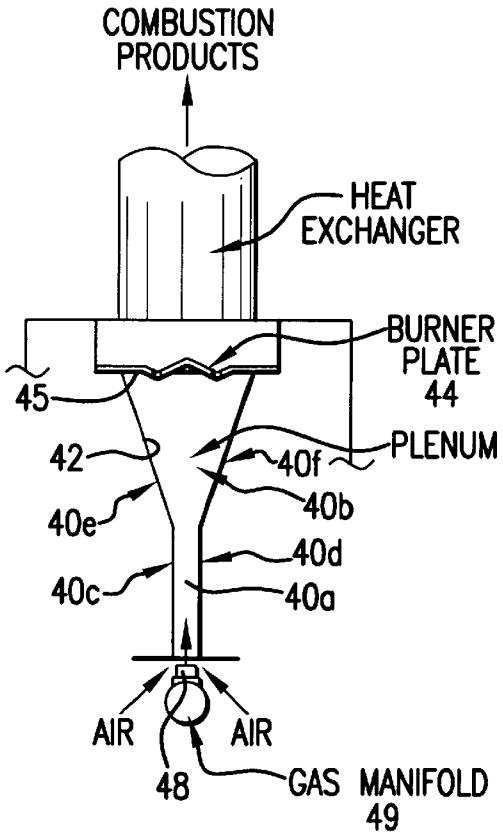
FIG. 11 is an end elevation of the burner/plenum configuration, according to the embodiment of FIG. 10.
Figure 10:
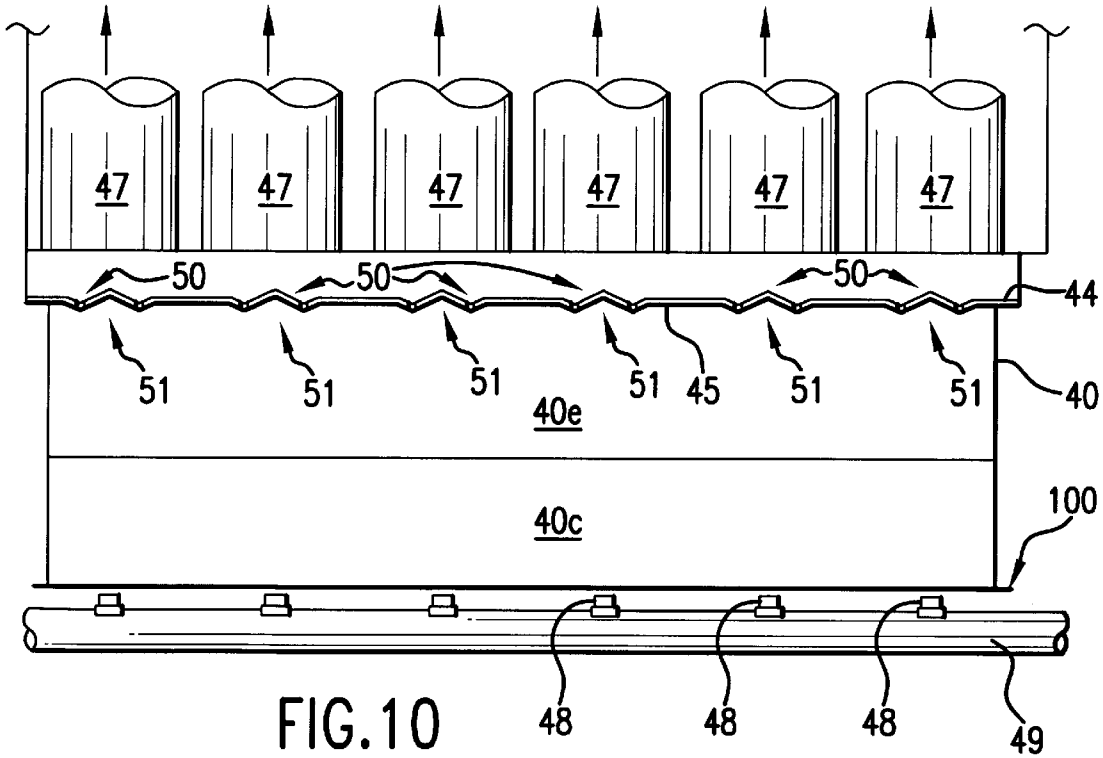
FIG. 10 is a top plan view, in section, of an alternative burner/plenum configuration.

FIGS. 10 and 11, illustrate portions of a burner/plenum configuration having a multiple feed plenum having a gas spud for each burner, wherein each flame holder region 50 of burner plate 44 preferably has the configuration of flame holder region 50 of FIGS. 8–11. Baffle plate 45 likewise has port regions 51, which are preferably the same as illustrated in FIGS. 5*b* and 7.

Plenum housing 40 forms a burner inlet plenum chamber 42. Plenum housing 40 has substantially flat sides, and thus a substantially constant width, and top and bottom walls 40*c* and 40*d*, respectively, having planar portions, defining a narrow mixing region 40*a* having a substantially constant thickness. A pressure recovery region 40*b* is defined by top and bottom walls 40*e* and 40*f*, respectively. Region 40*b* has a triangular cross-section providing a substantially increasing cross-section. As the mixed gases enter region 40*b*, the static pressure of the gases rises, while the dynamic pressure and linear velocity drop. Pressure recovery region 40*b* promotes the distribution of the mixed gases across the height of plenum housing 40.

Figure 12:
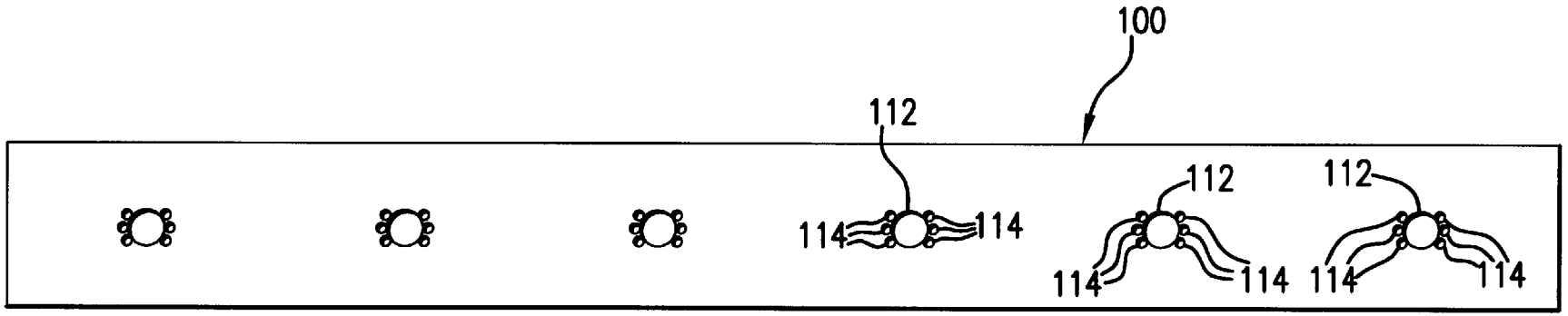
FIG. 12 is a schematic elevation of an air inlet plate configuration contemplated for use with the burner and plenum configurations of FIGS. 10 and 11 of the present invention.

Plenum chamber 42 is faced by baffle plate 45 having port regions 51. Baffle 45 provides a further pressure recovery region, between baffle 45 and burner plate 44, which is less abrupt than that in region 40*b*, promoting further distribution of the gases across the width of burner plate 44. By changing the side-to-side width of housing 40, a greater or lesser number of flame holder regions may be accommodated. Plenum housing 40 is supplied by separate gas spuds 48 opening from a gas manifold 49. The flames from flame holder regions 50 extend into heat exchanger tube(s) 47. FIG. 12 illustrates air inlet plate 100 preferably used in association with the burner construction of FIGS. 8–11. Air inlet plate 100 will be provided with a plurality of fuel inlet apertures 112, which will be positioned so as to be concentric to corresponding ones of gas spuds 48. Surrounding each fuel inlet aperture 112 will be a plurality of air inlet apertures 114. In operation, fuel is expelled, under sufficient pressure, from spuds 48 (FIG. 11) such that the entire stream of fuel gas passes through the respective fuel inlet apertures 112, and into plenum housing 40. Air ambient to the gas spuds 48 is drawn by inducer fan 134 (see FIG. 14) through air inlet apertures 114, to provide the combustion air for premixing in region 40*a*.

Figure 13:
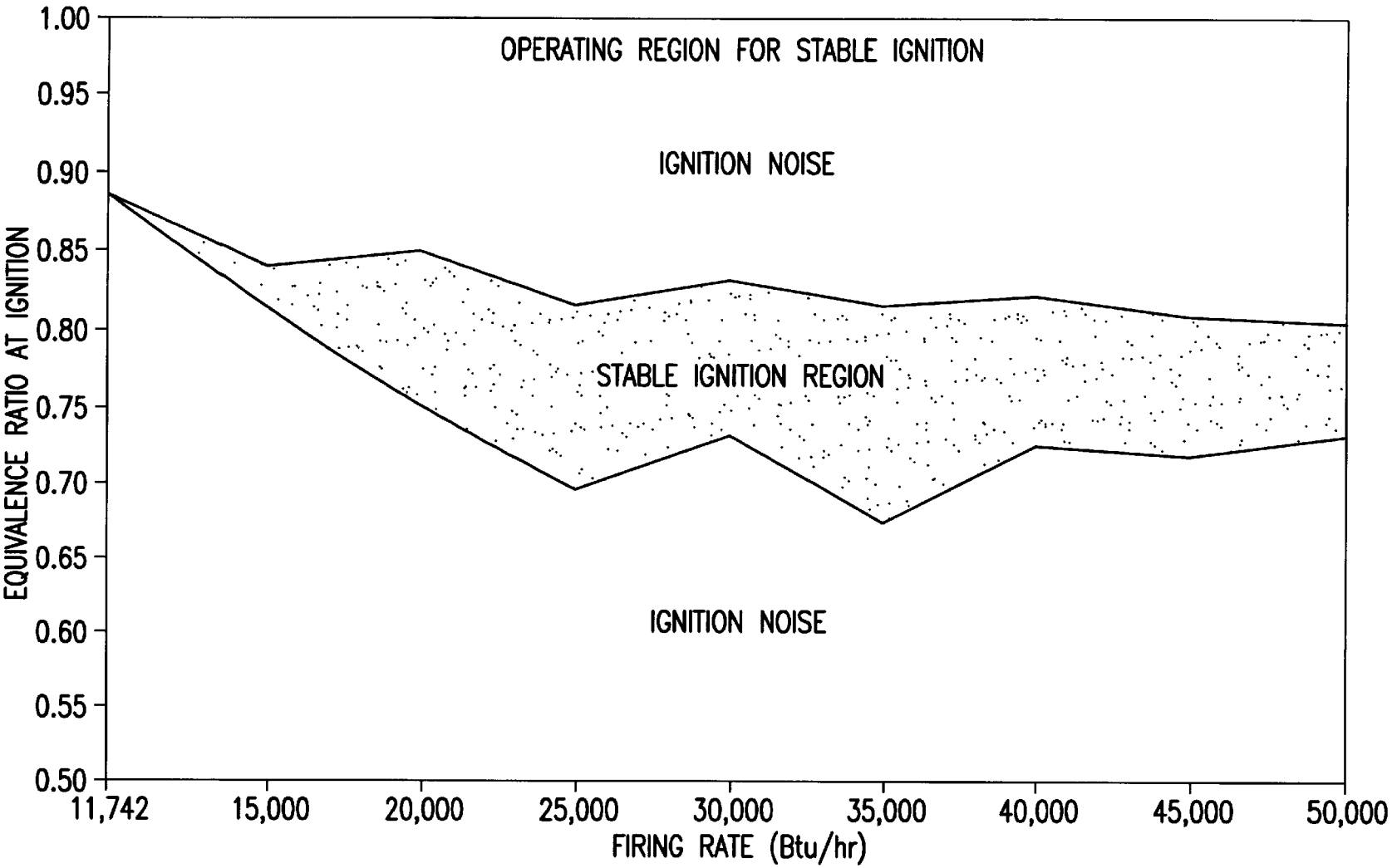
FIG. 13 is a plot of observed performance of a burner in accordance with the principles of FIGS. 8 and 9.

FIG. 13 illustrates noted performance of a burner having flame holders such as shown and described with respect to FIGS. 8 and 9.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

We claim:

1. A flame holder apparatus, for use with burner apparatus for gaseous fuels, of the type configured for holding a flame and directing the combustion products of the flame into a heat exchanger plenum, the flame holder apparatus comprising:

a plate member, having at least one flame holder region having a plurality of apertures, the apertures being configured into two regions, the apertures of a first region being disposed for directing flow through the plate and in a radially outward direction, relative to the at least one flame holder region, the apertures of a second region being disposed for directing flow through the plate and in a radially inward direction, relative to the at least one flame holder region.

2. The flame holder apparatus according to claim 1, wherein the at least one flame holder region further has a generally circular plan configuration.

3. The flame holder apparatus according to claim 2, wherein the first region comprises a circular area, centrally positioned in the at least one flame holder region.

4. The flame holder apparatus according to claim 3, wherein the second region comprises an annular area, surrounding the first region.

5. The flame holder apparatus according to claim 1, wherein the first region comprises a convex conical region, centrally positioned in the at least one flame holder region.

6. The flame holder apparatus according to claim 5, wherein the second region comprises an annular concave conical region centered within the at least one flame holder region.

7. The flame holder apparatus according to claim 1, wherein the second region comprises an annular concave conical region centered within the at least one flame holder region.

8. The flame holder apparatus according to claim 1, wherein the apertures in the plate are configured so that the flow of gas through the plate at each location on the plate is substantially perpendicular to the plate at that respective location.

9. The apparatus according to claim 1, wherein the apertures have predominantly uniform diameters.

10. The apparatus according to claim 9, wherein a plurality of apertures, positioned around a peripheral region of the at least one flame holder region, have diameters which are greater than the diameters of the apertures in remaining portions of the at least one flame holder region.

11. The apparatus according to claim 1, wherein the apertures have diameters which are of substantially the same order of magnitude as the lengths of the apertures through the plate.

12. The apparatus according to claim 1, wherein the at least one flame holder region comprises two flame holder regions disposed on the plate member, at laterally spaced positions relative to one another.

13. The apparatus according to claim 12, wherein a plurality of apertures is disposed extending between the two flame holder regions for providing cross-lighting between the two flame holder regions.

14. The apparatus according to claim 1, wherein at least some of the apertures in the at least one flame holder region are arranged in hexagonal groups.

15. The apparatus according to claim 5, wherein at least some of the apertures in the first region are arranged in hexagonal groups.

* * * * *